United States Patent [19]

Arcouette

[11] 4,229,850

[45] Oct. 28, 1980

[54] KAYAK

[76] Inventor: Pierre Arcouette, 39 rue Montagne Apt. 21, Granby, Quebec, Canada

[21] Appl. No.: 922,071

[22] Filed: Aug. 3, 1978

Related U.S. Application Data

[63] Continuation-in-part of Ser. No. 830,814, Sep. 6, 1977, abandoned.

[51] Int. Cl.[3] ..... B63B 35/00
[52] U.S. Cl. ..... 9/1.4
[58] Field of Search ..... 9/1.3, 1.4, 6 R, 6 P, 9/6 M, 7, 2 R, 2 C, 2 F

[56] References Cited

U.S. PATENT DOCUMENTS

| | | | |
|---|---|---|---|
| 2,346,895 | 4/1944 | Bergman | 244/122 R X |
| 3,611,461 | 10/1971 | Wurzberger | 9/6 P |
| 3,869,743 | 3/1975 | Brown et al. | 9/6 P |
| 3,982,293 | 9/1976 | Lagervall | 9/7 |
| 4,004,307 | 1/1977 | Hermann | 9/2 C |

FOREIGN PATENT DOCUMENTS

| | | | |
|---|---|---|---|
| 1120158 | 7/1968 | United Kingdom | 9/6 P |

*Primary Examiner*—Trygve M. Blix
*Assistant Examiner*—Jesus D. Sotelo

[57] ABSTRACT

A kayak characterized by a kayak hull molded of semi-rigid material stiffened by an internal frame structure which includes a bow and a stern beam units and a seat each of hollow and watertight construction to provide buoyancy and each of limited dimensions to be inserted through the opening in the top of the kayak. The beam units are engaged between the top and bottom walls of the hull, extend longitudinally and centrally of the latter forwardly and rearwardly of the passenger opening and have beam extensions projecting towards each other along the portion of the hull bottom wall opposite the passenger opening. The seat rests on both extensions, is preferably adjustable fore and aft along the latter and also engages the top of the kayak on both sides of the passenger opening to coact with the bow and stern parts in stiffening the semi-rigid hull.

17 Claims, 12 Drawing Figures

KAYAK

This is a continuation-in-part of co-pending U.S. patent application Ser. No. 830,814, Sept. 6, 1977, now being abandoned.

FIELD OF THE INVENTION

This invention relates to a kayak.

BACKGROUND OF THE INVENTION

The kayaks which have been proposed so far are found relatively expensive and are not very safe to use. The modes of construction used so far to make the kayaks require substantial labor and this makes the production expensive. The kayaks which have been made so far lack adequate framing to avoid collapse of the top and/or bottom toward each other.

OBJECTS OF THE INVENTION

It is a general object of the present invention to provide a kayak which is of relatively inexpensive construction.

It is another general object of the present invention to provide a kayak which is relative safer. It is an object of the present invention to provide a kayak with an internal frame structure which is dimensioned and shaped to be easily installed through the opening in the top of the hull and which provides a seat portion, also acting to strenghten the hull.

It is another object of the present invention to provide a kayak which is wholly and conveniently made of molded components allowing rapid construction and assembly.

It is a further object of the present invention to provide a kayak, the hull of which is integrally molded in a single piece and thus minimizes the possibility of leakage and thereby avoids the difficulty of achieving a leak-proof joint or seam between hull components.

It is still another object of the present invention to provide a kayak with an internal frame structure which is dimensioned and shaped to be easily installed through the opening in the top of the hull and which provides a seat portion, also acting to strengthen the hull.

It is a still further object of the present invention to provide a kayak having an internal frame structure which is of hollow construction to provide buoyancy to the kayak when the latter is submerged.

It is a more specific object of the present invention to provide a kayak whose hull is molded of semi-rigid plastic material and is stiffened by a simple internal frame structure including a seat whose outline produces transverse stiffening of the hull.

An important object of the present invention is to provide a kayak in which the seat is longitudinally adjustable to change the resultant center of gravity of the kayak and kayaker for better steering.

SUMMARY OF THE INVENTION

The kayak of the invention comprises an integrally molded one piece elongated kayak hull of semi-rigid material and defining a bottom wall, side walls and a top wall which latter has a passenger opening of restricted dimensions relative to said top wall so that the latter extends fore and aft and also laterally from said passenger opening, and an internal frame structure to stiffen said hull, said structure including three separate parts each having dimensions permitting its insertion within said hull through said passenger opening, two of said parts being each an elongated panel-like member positioned in an upright central longitudinal plane within said hull fore and aft of said passenger opening respectively, extending between and contacting and conforming to said top and bottom walls, each of said panel-like members having a beam extension projecting from the end of said member proximate to said passenger opening towards the beam extension of the other panel-like member, both beam extensions extending longitudinally along said bottom wall, contacting and conforming to the same, the third separate part being a seat located within said hull below said passenger opening, having a U-shaped cross-section, defining a lower central seating portion resting on said two beam extensions and a pair of upwardly directed side wings extending close to the respective side walls and having upper ends engaged underneath and contacting said top wall laterally of said passenger opening.

Preferably, the lower central seating portion of the seat also conforms to and contacts the bottom wall of the hull. Preferably also, the two side wings conform to and contact the respective side walls of the hull.

The above and other objects and advantages of the present invention will be better understood with reference to the following detailed description of preferred embodiments thereof which are illustrated, by way of example, in the accompanying drawings, in which:

DETAILED DESCRIPTION OF THE INVENTION

The illustrated kayak comprises a kayak hull 1, which is integrally molded into a single semi-rigid unit including a top wall 2, a bottom wall 3, and a passenger opening 4 in the central zone of the top wall to conventionally provide seating space for a single kayaker or user or, if desired, for more than one kayakar. The opening 4 is of limited width and length to be narrower than the width of the kayak so that the top wall 2 completely surrounds opening 4 defining a bow top wall portion, 4*a* a stern top wall portion, 4*b* and lateral top wall portions 4*e* extending forward, rearward, and laterally respectively from the kayak opening 4. Bottom wall 3 includes an intermediate bottom wall portion 3*a* located opposite opening 4, and bot and stern bottom wall portions 3*b* and 3*c* respectively facing bow and stern top wall portions 4*a* and 4*b*.

Figures 5, 6, 7, 8:
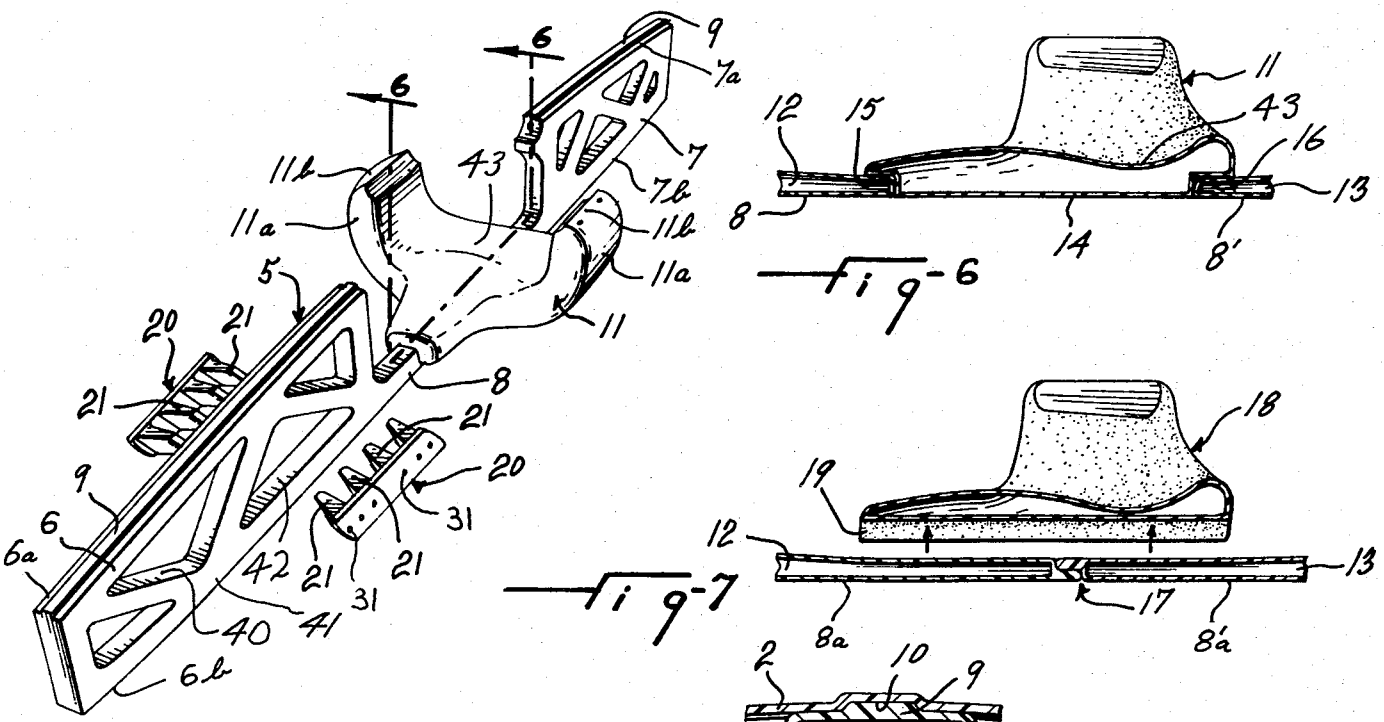
FIG. 5 is a perspective view of an internal frame structure forming part of the kayak of the preceding figures.
FIG. 6 is a longitudinal sectional view as seen along line 6—6 in FIG. 5.
FIG. 7 is the same as FIG. 6, except that the seat and beam portions are of different construction and lifted off the longitudinal beam portion.
FIG. 8 is a cross-sectional view as seen along line 8—8 in FIG. 2.

The kayak also comprises an internal frame structure wholly shown in FIG. 5. This internal frame structure is formed of three separate parts, namely a bow part 6, a stern part 7, and a seat part 11. Each of the bow part and of the stern part constitutes a distinct beam unit and is a panel-like member of generally rectangular outline including a top and a bottom edge surfaces 6*a*, 6*b*, or 7*a*, 7*b* which are complementary to the inside face of the bow top wall portion 4*a* and stern top wall portion 4*b* respectively of the top wall 2 and to the bow and stern bottom wall portions 3*b* and 3*c* in the longitudinal central zone of the hull 1. Thus, these beam units or bow and stern parts 6 and 7 when positioned in an upright plane longitudinally and centrally of the kayak hull, rigidify the hull and in particular the top wall and the bottom wall thereof.

The beam units or parts 6 and 7 form together a longitudinal beam 5 which longitudinally extends centrally intermediate the opposite side walls of the kayak hull. The longitudinal beam 5 thus extends in the fore and aft direction over at least the major portion of the length of the kayak. The top edge surface of both the bow part 6 and the stern part 7 is formed with a rib 9 which fits into a longitudinal groove 10 formed in the inner face of the top wall 2, as shown in FIG. 8. The bow part 6 has at its rear end, that is its end proximate to passenger opening 4, a rearwardly extending beam extension 8 while the stern part 7 has at its front end a forwardly extending beam extension 8'. The beam extensions 8, 8' are of much smaller height than the main portion of the bow part 6 and stern part 7, they underlie the kayak opening 4, and rest flat on the bottom wall 3. The beam extensions 8, 8' extend towards each other and are either interconnected by the seat part 11, as shown in FIGS. 5 and 6, or are made longer to abut each other end to end, as shown at 8*a* and 8'*a* in FIG. 7. The two parts 6 and 7 forming the longitudinal beam 5 are each integrally molded as a one place unit of double wall hollow construction to produce an internal buoyancy, water tight chamber 12 or 13, and are ot truss work construction to be lightweight. Each part 6 and 7 has triangular openings 40 opening at the two lateral main walls 41 of the part 6 or 7, said openings 40 having walls 42 joining with said main walls 41.

In either embodiment of the invention, the internal frame structure includes the seat part 11, 18 or 35 which is adapted to transversely stiffen the kayak hull. For this purpose, any seat part 11, 18 or 35 is of U-shaped cross-section and includes a lower central seating portion 43 and upwardly extending side wings 11a. Central seating portion 43 rests on beam extension 8, 8', contacts and conforms to bottom wall 3 on each side of beam extension 8,8'. Upwardly projecting lateral wings 11a conform with and are applied against the side walls of hull 1 and abut at their top end 11*b* against the inside surface of the lateral top wall portions 4*c* of the top wall on opposite sides of the opening 4. Each seat part 11, 18 or 35 is integrally molded as a one piece unit of double wall hollow construction forming a watertight chamber to provide buoyancy to the kayak.

Thus, the internal frame structure is made into three separate components or parts, including the two piece beam 5 and the seat part, which parts all cooperate to stiffen and strengthen the semi-rigid hull and prevent collapse thereof. Each of these three separate parts has a length not exceeding approximately the maximum distance of said kayak opening from the corresponding end of the kayak hull, and a maximum transverse dimension smaller than the transverse dimension of kayak opening such that these frame parts removably engage in the kayak hull through the passenger opening 4.

In the embodiment of FIGS. 5 and 6, the seating portion 43 of seat part 11 includes a bottom wall 14 which rests flat on the bottom 3 of the kayak hull and formed with a pair of notches 15 and 16 at the opposite ends for engagement therein of the corresponding ends of beam extensions 8, 8' of the two separate parts or components 6 and 7 of the longitudinal beam 5.

In the embodiment of FIG. 7, the beam extensions 8*a*, 8*a*' of the two component pieces or separate parts of the longitudinal beam 5 abut end to end and overlap at 17 under a different seat part 18. The latter is similar to the seat part 11, except that it is provided with a groove 19 extending lengthwise longitudinally and centrally in the bottom wall thereof. This groove 19 allows to rest the seat in appropriate position onto the beam extensions 8*a*, 8*a*' of the longitudinal beam 5 and onto the bottom 3 of the hull 1.

Figures 1, 2, 3, 4, 9:
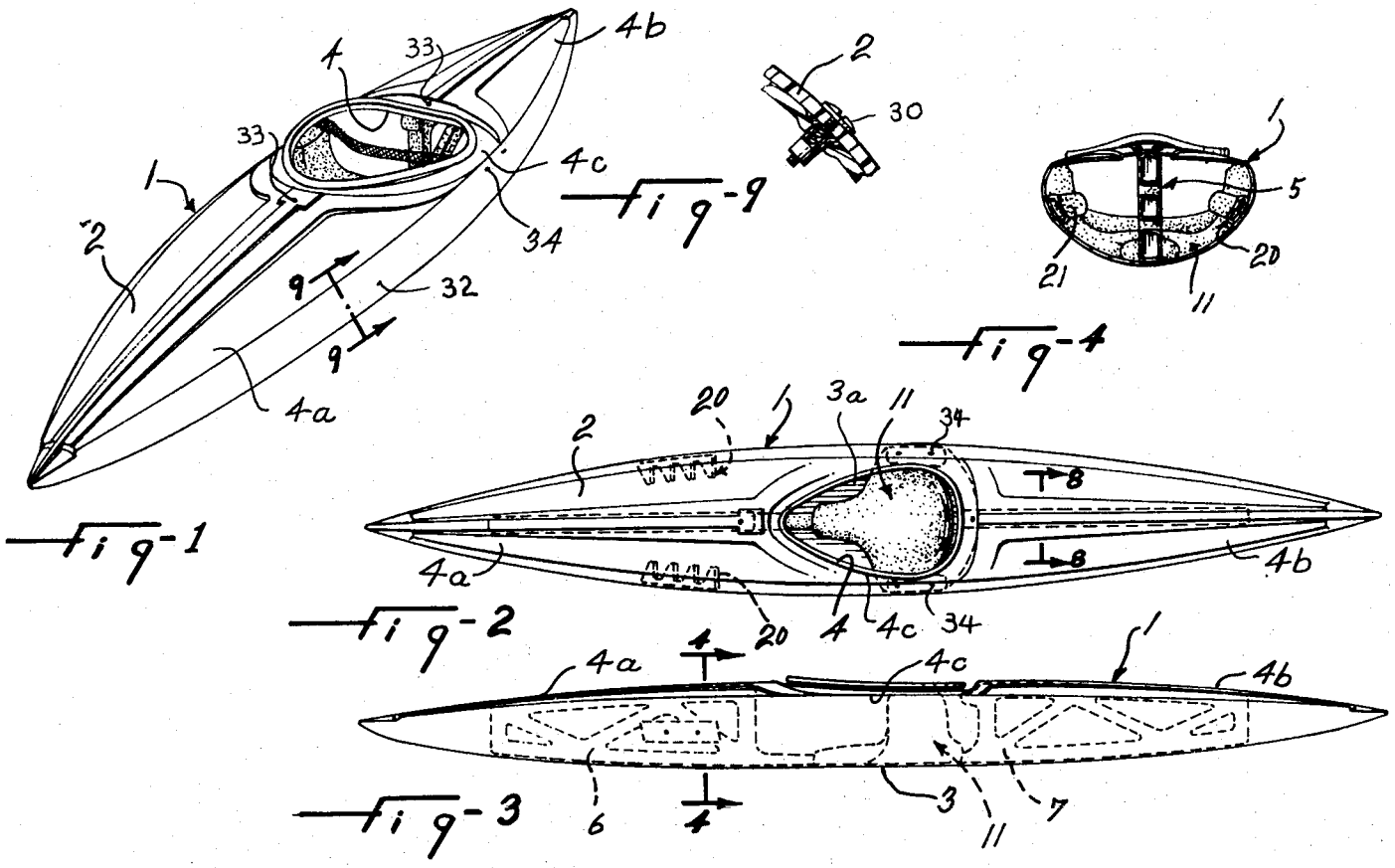
FIG. 1 is a perspective view of a kayak according to the present invention.
FIGS. 2 and 3 are top and side views respectively of the kayak of FIG. 1.
FIG. 4 is a cross-sectional view as seen along line 4—4 in FIG. 3.
FIG. 9 is a cross-sectional view as seen along line 9—9 in FIG. 1.

A pair of foot rests 20 are fixed to the sides of the kayak hull 1 forwardly of the seat and are each provided with a plurality of projections 21 to allow for legs of different lengths to find a rest against one or another of the projections. Bolt and nuts 30, as shown in FIG. 9, are used as fasteners to secure the various components one to another. A pair of fasteners 32 are inserted through the hull to engage one of three pairs of holes 31 made in footrests 20 to allow three positions of the latter. Thus the footrests, with their four projections 21, allow twelve positions for the user's feet. Each part 6 and 7 of the longitudinal beam 5 is fixed in place by a single fastener adjacent the opening 4, as shown at 33. An additional fastener could be used at the opposite ends of the beam. The seat part 11 is fixed in position by fasteners 34.

Figure 10:
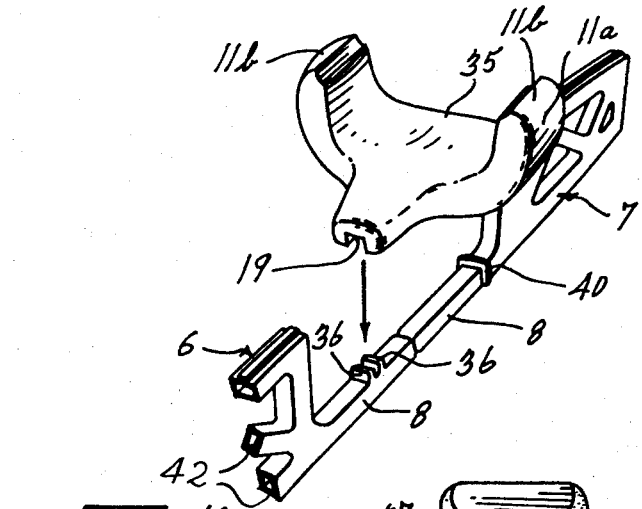
FIG. 10 is a perspective view of an internal frame structure with part broken away showing an adjustable seat embodiment as an alternative to the seat arrangement of the preceding Figures.
Figure 11:
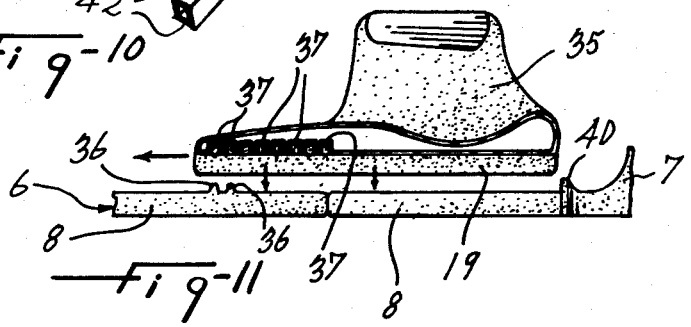
FIG. 11 is a central longitudinal cross-section through the seat of FIG. 10 shown in cooperation with the associated beam units.

In the embodiment of FIGS. 10 and 11, the rearward beam extension 8 of the beam unit 6 is provided with a pair of teeth 36 upwardly projecting therefrom. The seat part 35 is generally the same as the seat part 18 but distinctively includes a series of notches 37 provided in the channel 19 extending longitudinally in the bottom of the seat. Thus, the teeth 36 and notches 37 allow to longitudinally adjust the seat by engaging the teeth 36 in any selected pair of adjacent notches 37. Therefore, the kayaker can adjust the resultant center of gravity of the kayak and himself in accordance with his own weight to facilitate steering of the kayak. The rearward limit position of the seat 35 is determined by a shoulder 40 of forward beam extension 8 of beam unit 7 abutting the back of seat 35. With the adjustable seat, fasteners 34 are not used.

The transverse profile of the kayak hull 1 is constant in the zone of kayak opening 4 over at least the distance corresponding to the foremost and rearmost positions of seat part 35 so that the external surface of the latter bear against the hull walls in any adjusted position of the seat part.

Figure 12:
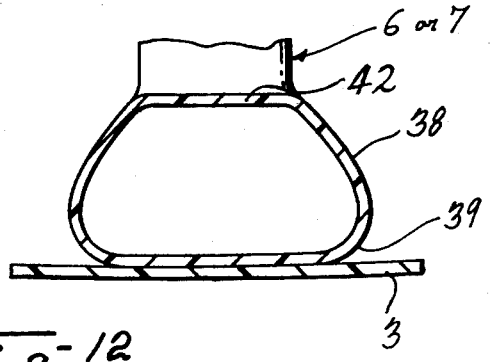
FIG. 12 is a partial section of a beam unit according to still another embodiment of the present invention.

As shown in FIG. 12, the lower portion of the beam units 6 and 7 is preferably formed over at least their portions not engaged by seat parts 11, 18 or 35 with a transversely enlarged base 38 to contact a larger band of the bottom wall 3. This enlargement 38 is formed with transversely rounded bottom edges at 39 to further reduce the possible shearing of bottom wall 3 by rocks contacting the latter along the sides of the beam units and causing transverse flexing of the hull bottom wall against those edges.

What I claim is:

1. A kayak comprising a semi-rigid elongated hull integrally molded in a single unit and defining a top wall, side walls and a bottom wall, said top wall having a passenger opening intermediate the ends of said hull, said top wall having bow and stern top wall portions extending between said opening and both ends of the hull respectively, said top wall further having lateral top wall portions extending between the sides of said opening and said side walls, said bottom wall having an intermediate bottom wall portion opposite said opening and bow and stern bottom wall portions extending between said intermediate bottom wall portion and both ends of the hull respectively and opposite said bow and stern top wall portions respectively, and an internal frame structure for stiffening said hull, said structure made of three separate component parts, each of a size allowing its insertion into said hull through said passenger opening, said component parts including a bow part, a stern part and a seat part, said bow part and stern part being each an elongated panel-like member positioned within said hull in an upright plane centrally and longitudinally of said hull, extending between said top wall and bottom wall and spaced from said side walls and each having continuous top and bottom edge surfaces conforming to and contacting the inside faces of said bow top and bottom wall portions and of said stern top and bottom wall portions respectively, said bow and stern parts each having a beam extension projecting from the end of the respective bow and stern parts adjacent said opening, said beam extensions projecting one towards the other longitudinally of said hull, having a top edge surface at a lower level than the top edge surface of said bow part and stern part, and having a bottom edge surface forming a continuation of the bottom edge surface of said bow part and stern part respectively and conforming to and contacting the inside face of said bottom wall, said seat part located opposite said opening having a central seating portion overlying and resting on both said beam extensions, extending transversely of said hull, conforming to and contacting said intermediate bottom wall portion on each side of said beam extensions and provided with upstanding lateral wings conforming to and contacting the inside face of the respective lateral top wall portions of said hull, whereby said seat part coacts with said bow part and said stern part to resist upward thrust which may be exerted on said bottom wall.

2. A kayak as defined in claim 1, wherein said upstanding lateral wings also conform to and contact the inside faces of the respective lateral walls of said hull to resist lateral thrust which may be exerted on said lateral walls opposite said lateral wings.

3. A kayak as defined in claim 1, wherein each of said bow part and stern part is made of integrally molded double wall hollow construction defining a watertight chamber and each has a plurality of triangular openings extending between and opening at the two lateral main walls of said parts, said openings having walls joining with said lateral main walls to form a truss-like structure.

4. A kayak as defined in claim 3, wherein said seat part is made of integrally molded double wall hollow construction defining a watertight chamber extending in said central seating portion and in both lateral wings, said central seating portion having an upper seating wall and a lower wall which conforms to and makes contact with said bottom wall of said hull, said lower wall forming a central recess opening at the front and back ends of said seat and receiving said beam extensions.

5. A kayak as defined in claim 4, wherein said beam extensions approach each other at their outer ends and said central recess forms a continuous channel to receive both beam extensions.

6. A kayak as defined in claim 5, wherein the outer ends of said beam extensions overlap each other.

7. A kayak as defined in claim 1 or 3, wherein the continuous top edge surfaces of said bow part and of said stern part are each provided with a centrally disposed, and longitudinally extending, rib and the inside face of said top wall of said hull is provided with a groove engaged by said ribs.

8. A kayak as defined in claim 1 or 4, further including two footrests rigidly secured to the inside face of said side walls forwardly of said opening, each footrest consisting of a base member and of a plurality of lateral projections spaced one from the other longitudinally of the hull, said projections accommodating users' legs of different lengths.

9. A kayak as defined in claim 5, wherein said channel includes notches serially spaced longitudinally of the kayak, and one of said beam extensions includes at least one tooth adjustably engaging one of said notches and positioning said seat part lengthwise of the kayak.

10. A kayak as defined in claim 1 or 4, wherein said seat is adjustably movable forwardly and backwardly relative to said kayak hull and further including means to lock said seat in adjusted position against movement relative to said hull.

11. A kayak as defined in claim 1 or 4, wherein said the bottom longitudinal edge portion of each of said bow part and stern part forms a transversely enlarged base relative to remaining portion of said bow part and stern part, said enlarged base having rounded corners.

12. A kayak as claimed in claim 1 or 4, wherein said bow part, said stern part and said seat part are each made of double wall hollow construction, each defining water-tight chambers providing buoyancy to the kayak.

13. A kayak as claimed in claim 1 or 4, wherein each of said bow part, stern part and seat are integrally molded in a single unit of double wall hollow construction and each defining a water-tight chamber.

14. A kayak comprising an integrally molded one piece elongated hull of semi-rigid material and defining a bottom wall, side walls and a top wall which latter has a passenger opening of restricted dimensions relative to said top wall so that the latter extends fore and aft and also laterally from said passenger opening, and an internal frame structure to stiffen said hull, said structure including three separate parts each having dimensions permitting its insertion within said hull through said passenger opening, two of said parts being each an elongated panel-like member positioned in an upright central longitudinal plane within said hull fore and aft of said passenger opening respectively, extending between, contacting and conforming to said top and bottom walls, each of said panel-like members having a beam extension projecting from the end of said member proximate to said passenger opening towards the beam extension of the other panel-like member, both beam extensions extending longitudinally along said bottom wall, contacting and conforming to the same, the third separate part being a seat located within said hull below said passenger opening, having a U-shaped cross-section defining a lower central seating portion resting on said two beam extensions and a pair of upwardly directed side wings extending close to the respective side walls and having upper ends engaged underneath and contacting said top wall laterally of said passenger opening.

15. A kayak as defined in claim 14, wherein said central seating portion conforms to and contacts said bottom wall on each side of said two beam extensions and said side wings conform to and contact the side walls of said hull.

16. A kayak as defined in claim 15, wherein each of said panel-like members is made of integrally molded double wall hollow construction defining a watertight chamber and each has a plurality of triangular openings extending between and opening at the two lateral main walls of said panel-like members, said openings having walls joining with said lateral main walls to form a truss-like structure.

17. A kayak as defined in claim 16, wherein said seat is made of integrally molded double wall hollow construction defining a water-tight chamber and said lower central seating portion has a top wall and a bottom wall, said bottom wall forming a central longitudinally extending channel receiving both said beam extensions, the bottom of said channel including notches serially spaced longitudinally of the kayak and the beam extension of the panel-like member positioned within said hull forwardly of said passenger opening being provided with at least one upstanding tooth adjustably engaging one of said notches for removably positioning said seat lengthwise of the kayak.

* * * * *